United States Patent [19]

Stephenson

[11] Patent Number: 4,710,675

[45] Date of Patent: Dec. 1, 1987

[54] SOLID DYNODE STRUCTURE FOR PHOTOMULTIPLIER

[75] Inventor: Kenneth E. Stephenson, Pennington, N.J.

[73] Assignee: Sangamo Weston, Inc., Norcross, Ga.

[21] Appl. No.: 728,135

[22] Filed: Apr. 29, 1985

[51] Int. Cl.[4] ..... H01J 43/06; H01J 43/22

[52] U.S. Cl. ..... 313/532; 313/535; 313/297

[58] Field of Search ..... 313/535, 532, 297, 528, 313/529, 533, 104, 105 R, 423, 103 R; 250/213 VT, 207

[56] References Cited

U.S. PATENT DOCUMENTS 2,836,755 5/1958 Sommer ..... 313/297 X 3,498,834 3/1970 Rome et al. ..... 313/535 X

*Primary Examiner*—Palmer C. DeMeo

*Assistant Examiner*—K. Wieder

*Attorney, Agent, or Firm*—Dale Gaudier

[57] ABSTRACT

A photomultiplier includes a solid disk dynode and a pair of annular guiding electrodes disposed about the disk dynode transversely along the central axis of the photomultiplier tube on opposite sides of the dynode. The secondary and subsequent dynodes may be of conventional (e.g. venetian blind) construction or of solid disk construction. The solid disk dynode and guiding structure exhibits improved photoelectron pulse-height resolution and a better signal-to-noise ratio than a conventional venetian blind type dynode. In addition, the solid dynode structure is less susceptible to physical shock than conventional photomultiplier dynode designs.

10 Claims, 5 Drawing Figures

SOLID DYNODE STRUCTURE FOR PHOTOMULTIPLIER

BACKGROUND OF THE INVENTION

1. Field of the Invention

The present invention relates to the field of photomultipliers, and in particular to a solid dynode structure which is rugged and exhibits good pulse height resolution.

2. Description of the Prior Art

Photomultipliers come in a wide variety of forms. One type of photomultiplier utilizes a so-called "venetian blind" dynode structure wherein the dynode is formed from a series of slats or vanes arranged at an angle to the path of a photoelectron emitted from the photoemissive surface of a photocathode, or a secondary electron emitted from a preceding dynode stage. Such dynode structures are well-known and are shown in U.S. Pat. No. 3,498,834 and described in the *RCA Photomultiplier Handbook,* 1980, page 29.

The venetian blind dynode structure is particularly useful in environments where the photomultiplier tube may be subject to large shocks or vibrations, such as might be encountered in a spacecraft or in a well-logging operation. This is because the dynode is fully supported about its periphery by an electrically conductive mounting which also acts as the external electrical connection for the dynode.

One drawback to the venetian blind dynode structure is that it does not provide good pulse height resolution for low levels of incident photoelectrons. Under very low light level conditions (e.g., 50 or less electrons incident on the dynode), the output of the photomultiplier tube will no longer be proportional to the number of electrons impinging on the first dynode, but will fluctuate in a random fashion due to statistical variations in the numbers of secondary electrons emitted by the dynodes and the statistics of capturing and guiding these secondary electrons to the next dynode. The ability to discriminate between events which produce different numbers of photoelectrons is also reduced because of these statistical fluctuations.

These variations are due, in part, to the open structure of the venetian blind dynode which allows a large percentage (e.g., 30%) of the incident primary electrons to completely miss the first dynode.

The collection of secondary electrons by a succeeding dynode stage also varies with the position the incident primary electron strikes the vane of the preceding dynode stage. This is because each venetian blind dynode usually includes a screen or grid arranged just ahead of it which is held at the same potential as its associated dynode. This sets up an area of equal potential near the forward (leading) edges of the vanes of the dynode, and serves to improve collection of the secondary electrons emitted from the dynode by allowing the electrons to travel a short distance from the dynode within the region of equal potential. However, secondary electrons emitted from the leading edge of a dynode vane are less likely to be accelerated to the next dynode stage than are secondary electrons emitted from the rearward (trailing) edge of the vane because the influence of the potential applied to the next dynode stage is slightly less on the leading edge of the vane than on the trailing edge. This effect makes the collection efficiency of a succeeding dynode stage somewhat dependent on the location of where a primary electron strikes the preceding dynode.

One alternative type of dynode structure which does provide relatively good pulse height resolution is the so-called "box and grid" dynode structure, such as shown on page 29 of the aforementioned *RCA Photomultiplier Handbook.* However, such a dynode structure has the drawback that the dynode and electron focusing elements cannot be easily mounted within the photomultiplier tube in a rugged manner. This prevents this type of dynode structure from being used in those environments where the tube may be subject to high levels of shock and/or vibration. Also, the components used in the box and grid dynode structure are not symmetrical and thus can result in asymmetries in electron focusing and collection unless their designs are carefully executed.

In order to improve the electron collection efficiency in a photomultiplier it is known to use a dynode formed from a solid sheet of material oriented in a plane substantially perpendicular to the path of electrons to be accelerated. Such solid dynode structures are shown in U.S. Pat. Nos. 2,196,278 and 2,203,225. The arrangement shown in U.S. Pat. No. 2,196,278 utilizes dynodes formed from a thin metal foil which are mounted to the wall of the photomultiplier by a single, slender support arm. However, this dynode structure is too weak to be able to withstand high levels of shock or vibration. Also the secondary electron coefficient of this device is low because an incoming primary electron must travel through the foil dynode before a secondary electron is emitted.

U.S. Pat. No. 2,203,225 shows a disk-type solid dynode arranged with its surface substantially perpendicular to the longitudinal axis of the photomultiplier tube and surrounded by a cup-shaped electron focusing structure. The dynode and cup-shaped focusing structure are mounted to the wall of the photomultiplier using a single support arm. This arrangement, similar to the support arm used in U.S. Pat. No. 2,196,278, will not support the dynode structure properly if the photomultiplier tube is subject to high levels of shock or vibration.

In addition, both these photomultiplier tubes require the use of external magnetic focusing coils in order to focus the electrons being accelerated by each stage of the photomultiplier tube. Such focusing coils increase the diameter and weight of the photomultiplier tube, thus rendering them less desirable for use in situations where size is critical, such as in the well-logging or spacecraft environments. Also, such focusing coils require a separate source of electrical potential, in addition to the potential source for the dynodes.

SUMMARY OF THE INVENTION

These and other disadvantages of prior art dynode structures are overcome by the present invention in which a solid dynode and its associated electron guiding structures are rigidly mounted to the wall of a photomultiplier tube. The dynode is formed from a solid disk of electrically conductive material exhibiting secondary electron emission and is oriented in a plane substantially perpendicular to the longitudinal axis of the photomultiplier tube. A first guide electrode, formed from a cylindrical ring of electrically conductive material, is arranged symmetrically about the longitudinal axis of the photomultiplier and slightly ahead of the dynode in the direction of incoming electrons. This guide electrode further includes an annular flange formed along a portion of the ring farthest from the dynode, with the flange oriented in a plane substantially perpendicular to the longitudinal axis of the photomultiplier tube. A second guide electrode is also formed from a cylindrical ring of electrically conductive material and is arranged symmetrically about the longitudinal axis of the photomultiplier tube and radially surrounding the solid dynode. This electrode further includes an annular flange formed along a portion of the ring farthest from the dynode and on the side of the dynode opposite to that of the first guide electrode, with this flange being oriented in a plane substantially perpendicular to the longitudinal axis of the photomultiplier tube.

An electrically conductive grid having a semi-hemispherical shape is disposed between the disk dynode and a subsequent dynode or othr electron collecting element (e.g., the anode) of the photomultiplier, and means are provided for applying electrical potentials to the dynode, first and second guide electrodes and the grid in order to control and guide the trajectories of secondary electrons emitted from the disk dynode. In particular, the potential applied to the first guide electrode is slightly negative with respect to the potential applied to the dynode and the second guide electrode (which are at the same potential) and the potential applied to the grid is more positive than that applied to the dynode and second quide electrode.

With the foregoing arrangement, the first and second guide electrodes cooperate together to cause substantially all secondary electrons ejected from the front surface of the dynode, due to impacts from the electrons coming from a previous dynode stage or from the photocathode, to be guided away from the first guide electrode and between the dynode and second guide electrode and through the grid and focused in an area on the opposite side of the grid.

Preferably, the area where the electrons are focused includes an electron collecting structure, such as another dynode or the anode of the photomultiplier tube.

The above arrangement enables the first and second guide electrodes and grid to be completely supported about their peripheries by an electrically conductive ring electrode and mounted in a secure and rugged fashion to the walls of the photomultiplier tube in a fashion similar to that shown in the aforementioned U.S. Pat. No. 3,498,834.

The disk-shaped dynode is preferably attached to the inner periphery of the second guide electrode by means of at least three radial support arms, at least one of which is electrically conductive. This arrangement provides good rigidity and immunity from shock and vibration for the dynode, while causing little effect on the paths of secondary electrons moving from the front surface and around the edge of the dynode.

In addition to providing a rugged and simple dynode and electron guiding structure, the particular geometry of the disk dynode and first and second guide electrodes insures that virtually all secondary electrons emitted from the front surface of the dynode are captured and guided around the edge of the dynode and to the next dynode stage or other electron collecting structure. If desired, an electrically conductive grid may be arranged in the opening formed by the flange of the first guide electrode to further enhance the containment and guiding of the secondary electrons away from the first electrode and around the dynode. The capture and guiding of secondary electrons is relatively uniform across the entire face of the solid disk dynode, thus insuring that the photomultiplier will have good pulse height resolution, even where the number of incident electrons on the solid dynode is very low.

The foregoing arrangement also enables the secondary electrons to be collected and guided purely electrostatically without the need for bulky and heavy external magnetic coils and their associated electrical driving circuitry. This results in a more compact, simple and reliable photomultiplier structure.

While the above described arrangement is particularly useful as the first dynode in a multi-dynode photomultiplier tube, the integral disk dynode and second guide electrode assembly may also be utilized in subsequent dynode stages in place of more conventional dynode structures.

BRIEF DESCRIPTION OF THE DRAWING FIGURES

These and other features and advantages of the present invention will become apparent from the following description of the preferred embodiment of the invention, when taken in conjunction with the accompanying drawing figures wherein.

Figure 2:
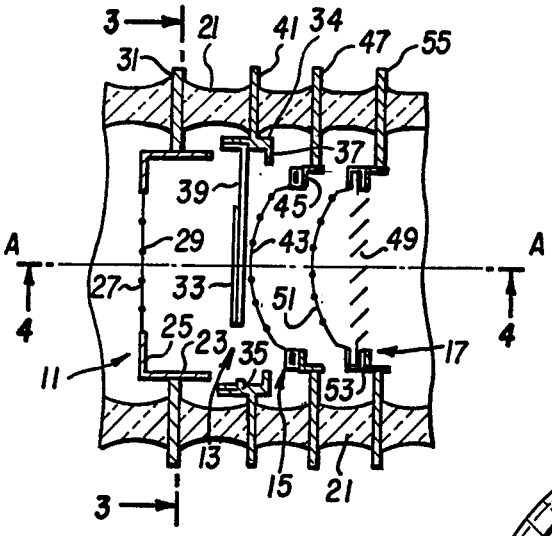
FIG. 2 is a cross-section of a portion of the photomultiplier tube shown in FIG. 1 illustrating the arrangement of the dynode and electron guiding structures.
Figure 4:
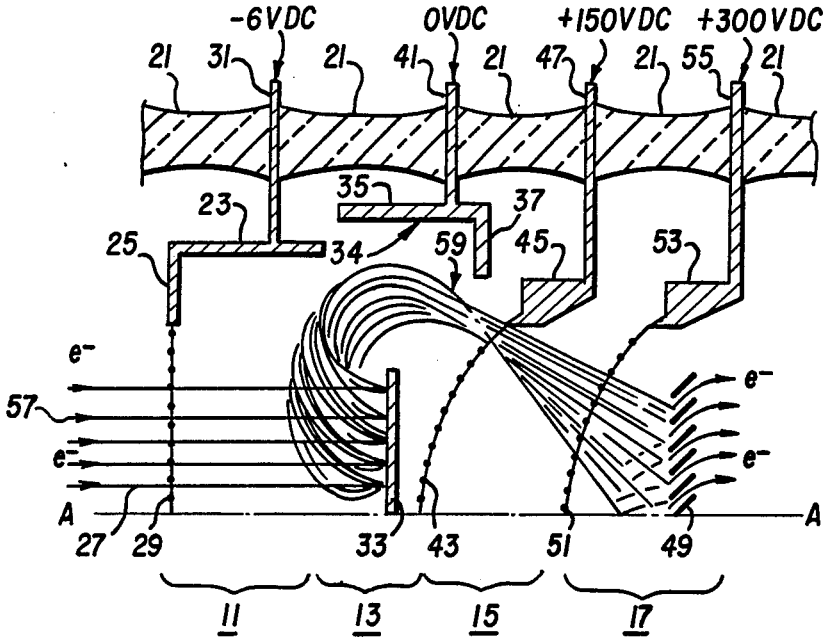
Figure 5:
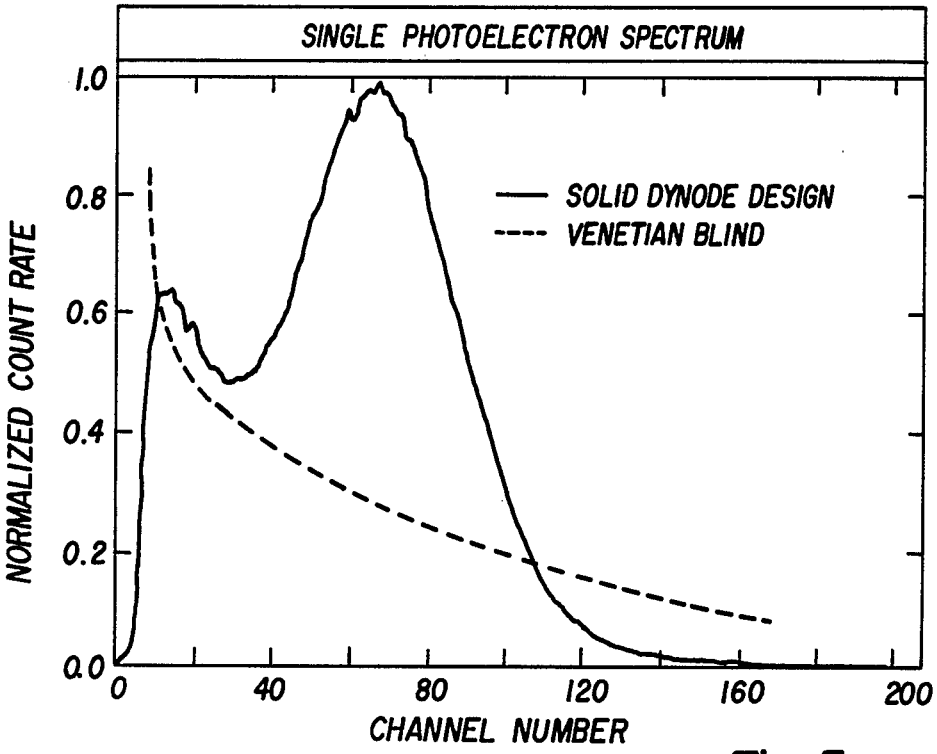

FIG. 4 is a diagrammatic cross-section of the photomultiplier tube shown in FIG. 2 taken along lines of 4—4 and illustrating the paths taken by secondary electrons emitted from the dynode; and FIG. 5 is a graph illustrating the performance of a photomultiplier tube constructed in accordance with the principles of the present invention versus the performance of a photomultiplier tube utilizing a conventional venetian blind first dynode.

DETAILED DESCRIPTION OF THE PREFERRED EMBODIMENT

Figure 1:
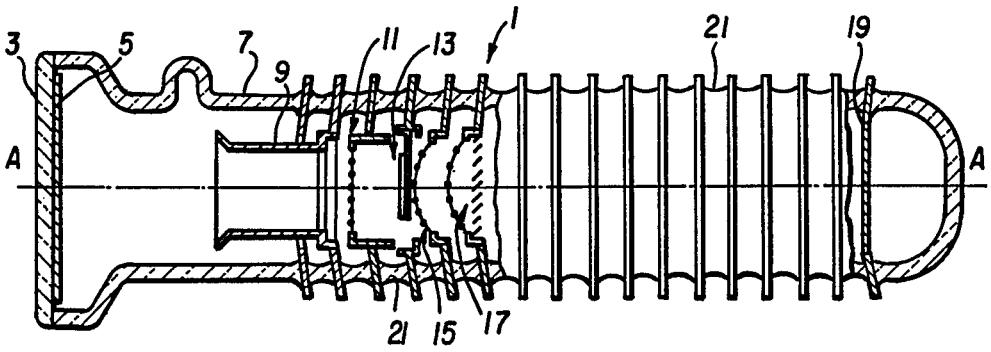
FIG. 1 is a partial sectional view of a photomultiplier tube constructed in accordance with the principles of the present invention.

FIG. 1 shows a photomultiplier tube 1 constructed in accordance with the principles of the present invention. Photomultiplier 1 comprises a faceplate or window 3 formed from a material which is relatively transparent to the wavelengths of radiation of interest. A photocathode material 5 is disposed on the interior face of window 3 and is formed from any of a variety of well-known radiation sensitive and photoemissive materials.

Window 3 is attached to a tubular neck section 7, formed from glass, which forms the forward section of photomultiplier 1. A focusing electrode 9 is arranged about the longitudinal axis (A) of the photomultiplier and spaced apart from window 3.

To the right of first focusing electrode 9 (as shown in FIG. 1), there is a first electron guiding electrode, generally indicated at 11, followed by a solid dynode assembly, denoted generally at 13.

Following solid dynode assembly 13 is a first grid assembly 15, followed by a second dynode stage, denoted generally at 17. There may be one or more additional dynode stages (not shown) following dynode stage 17 and constructed in a similar manner.

A disk-type collecting anode 19 is disposed at the opposite end of the photomultiplier 1 from window 3 and serves to collect electrons emitted by a final dynode stage.

As shown in FIG. 1, focusing electrode 9, the first guide electrode 11, each of the dynode stages, and the anode are electrically connected to annular rings formed from an electrically conductive material, such as Kovar (an iron-nickel-cobalt alloy), which act as the connection points for application of electrical potentials to each of these elements. The focusing and guide electrodes, dynodes, and anodes are separated from one another by a series of glass rings or spacers 21. Alternatively, spacers 21 may be made of a ceramic material.

FIG. 2 shows in more detail the arrangement of the first guide electrode 11, solid dynode assembly 13, grid 15 and a second dynode stage 17.

In particular, the first guide electrode 11 comprises a ring of electrically conductive material, such as Kovar, having a first portion 23 of cylindrical cross-section and arranged symmetrically about the longitudinal axis A of the photomultiplier, and an annular flange portion 25 connected to the forward or leading edge of the cylindrical portion 23 (i.e. leftward as shown in FIG. 2).

The radially inward edge of annular flange portion 25 defines an opening 27 in which there is mounted a screen or grid of very fine electrically conductive mesh 29.

The radially outward surface of portion 23 of the first guide electrode is connected to an annular electrode 31, also formed from Kovar, to which a source of electrical potential, external to photomultiplier 1, may be attached.

Solid dynode assembly 13 comprises a disk 33 having its planar surface oriented substantially perpendicular to the longitudinal axis A of the photomultiplier. Disk dynode 33 is formed from an electrically conductive material, such as beryllium copper, and has its front (leftward in FIG. 2) surface coated with a material exhibiting good secondary electron emission, such as beryllium oxide. Disk dynode 33 is surrounded by a second guide electrode 34 formed from an electrically conductive material, such as Kovar. Guide electrode 34 includes a first portion 35 of cylindrical cross-section and an annular flange 37 mounted to the trailing (rearward) edge of cylindrical portion 35 (to the right in FIG. 2). Annular flange 37 is oriented substantially perpendicular to the longitudinal axis A of the photomultiplier, with the radially inward edge of the flange defining an opening therein. Second guide electrode 34 does not overlap any portion of first guide electrode 11.

Figure 3:
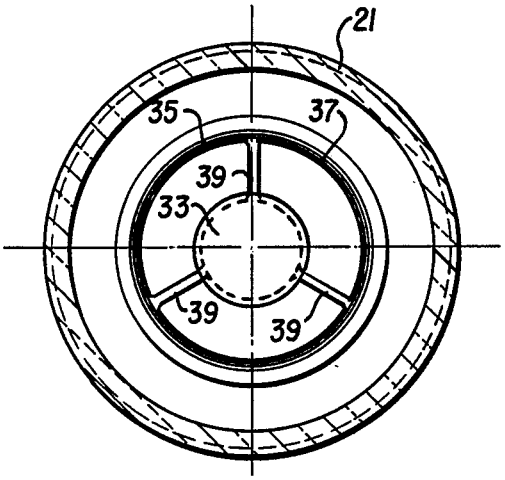
FIG. 3 is a cross-section of the photomultiplier tube shown in FIG. 2 taken along lines 3—3.

Disk 33 is connected to the inner periphery of cylindrical portion 35 of guide electrode 34 by means of three support arms 39, as shown more clearly in FIG. 3. Dynode support arms 39 are formed from an electrically conductive material such as nickel, and serve to electrically connect disk dynode 33 to guide electrode 34. Although three equiangularly spaced arms 39 are shown in FIG. 3, it will be understood that other numbers and orientations of the arms may be utilized.

The radially outer periphery of guide electrode 34 is mounted to an annular electrode 41 similar in structure to electrode 31.

Following dynode assembly 13 is grid assembly 15 comprising a semi-hemispherical screen or grid 43 formed from an electrically conductive mesh of fine wires, with its convex face oriented toward disk dynode 33. Grid 43 is attached along its radially outer periphery to an electrically conductive mounting ring 45 and thence to an annular electrode 47.

Following grid assembly 15 is a second dynode stage 17 comprising a dynode 49 of the venetian blind type and a semi-hemispherical grid 51 similar in construction and orientation to grid 43. Both dynode 49 and screen 51 are mounted about their radially outward peripheries to an electrically conductive mounting ring 53 and thence to an annular electrode 55.

Photomultiplier 1 may include further dynode stages following stage 17 of similar construction.

FIG. 4 shows in schematic form the effect of the solid dynode and associated electron guiding structures on the paths of incoming primary electrons 57 and secondary electrons 59 emitted from the surface of the disk dynode when appropriate electrical potentials are applied to the guide electrodes, the dynode, and the grid assembly.

Incoming primary photoelectrons 57, ejected from photoemissive material 5 of the photomultiplier (FIG. 1) are focused by focus electrode 9 through opening 27 of the first guide electrode 11. Primary photoelectrons 57 travel through the fine mesh of screen 29 and impact the secondary electron emissive surface of disk dynode 33. Incoming primary photoelectrons 57 will have energies of up to around 300 electron volts and their impact into the front surface of disc dynode 33 will cause secondary electrons to be ejected from the front surface of disk dynode 33 and back toward opening 27, with these secondary electrons having varying energies of up to around 6 electron volts.

In order to prevent these secondary electrons from escaping through opening 27, first guide electrode 11 is connected to a source of electrical potential which is slightly negative (e.g. −6 volts DC) with respect to dynode 33. By holding first guide electrode 11 at a slightly negative potential with respect to the dynode, virtually all but the most energetic secondary electrons 59 ejected from the front surface of disk dynode 33 will be repelled away from opening 27 and the inner periphery of the first guide electrode. Guide electrode 11 therefore acts as a so-called "electron mirror" to reflect secondary electrons 59 away from openine 27 and back toward disk dynode 33.

Second guide electrode 34 is held at the same potential as disk dynode 33, so as to create a region of equal potential in the annular area between guide electrode 34 and the outer periphery of disk dynode 33. A positive potential (approximately +150 volts DC with respect to the dynode and second guide electrode) is applied to grid 43. Because of the proximity of grid 43 to dynode 33, the positive potential of grid 43, "leaks" around the periphery of the disk dynode and into the area between the edge of the dynode and both the first and second guide electrodes 11 and 34. This, in combination with the electron mirror effect caused by first guide electrode 11, causes virtually all the secondary electrons 59 ejected from the front surface of dynode 33 to be guided around the edge of the dynode, through the annular area defined between the edge of the dynode and guide electrode 34, and toward the next set of dynodes 49. Since grid 43 is of a fine mesh, virtually all the secondary electrons 59 move freely through the mesh.

Dynode 49 and grid 51 have an even more positive potential (e.g. +300 volts DC) applied to them with respect to the potential applied to grid 43. This causes the secondary electrons 59 traveling around dynode 33 to be attracted through grids 43 and 51 and to impact the surface of dynode 49.

The foregoing arrangement provides several advantages. The disk dynode is rigidly attached at several points about its periphery to its associated guide electrode and therefore may be used in environments subject to high shock and vibration. The construction of the disk dynode and first and second guide electrodes is simplified since each is radially symmetric about the longitudinal axis of the photomultiplier. This arrangement eliminates those problems associated with guiding and focusing electrons which can occur with prior art asymmetrical electrodes and dynodes. Virtually all secondary electrons emitted from the surface of the dynode are collected and guided around the edge of the dynode and focused onto a subsequent dynode stage. This guiding takes place utilizing only electrostatic guiding structures, internal to the photomultiplier tube, and thus dispenses with the necessity of an external electromagnetic guiding coil structure. Since the entire surface of the dynode is solid and perpendicular to the longitudinal axis of the photomultiplier tube, and hence to the average trajectory of incoming primary electrons, virtually all primary electrons will impact the surface of the dynode and there will be little or no variation in the secondary electron emission coefficient of the disk dynode, regardless of where the primary electron impacts. This increases the collection efficiency of the photomultiplier and its ability to discriminate between events which have different numbers of primary photoelectrons (i.e. better pulse height resolution).

A photomultiplier tube constructed in accordance with the principles of the present invention is therefore rugged and provides good pulse height resolution even under very low light level conditions.

To illustrate this, FIG. 5 compares the spectral sensitivity to single primary electrons (pulse height resolution) of a photomultiplier tube constructed in accordance with the principles of the present invention (solid line) with a photomultiplier tube utilizing a standard venetian-blind first dynode structure (dashed line). Measurements were made of the normalized count rate, i.e. the number of photons detected by the photomultiplier normalized so that the maximum number of photons detected is equal to one, versus the channel number of the photomultiplier, i.e. a number which is proportional to the number of electrons output by the photomultiplier (i.e. the pulse height). As can be seen, the performance of a photomultiplier tube constructed in accordance with the principles of the present invention is superior in terms of its ability to resolve the number of photoelectrons incident on the first dynode, compared to the standard photomultiplier tube structure.

While the present invention has been described in considerable detail, it will be understood that various changes and modifications will occur to those skilled in the art. For example, while only the first dynode stage has been shown as being of the solid disk-type, it will be appreciated that the solid dynode assembly (disk 33 and annular guide electrode 34) may be utilized in place of a conventional venetian blind dynode structure (e.g. items 49 and 51), so long as each succeeding solid dynode assembly is separated from the preceeding dynode stage by a grid assembly, such as shown at 15 in FIG. 2. In addition, screen 29 of the first guide electrode 11 may be dispensed with where there are no strong, electron-attractive potentials applied to structures preceding this first guide electrode. It will be appreciated that a scintillator or light source may be placed directly ahead of the first guide electrode 11 (i.e. by omitting window 3, photocathode 5 and focusing electrode 9) so that the disk dynode 33 itself can function as an opaque cathode, where the high quantum yields associated with such an arrangement are desired.

The foregoing description is therefore to be taken as illustrative, but not limitative, of the invention which is defined by the appended claims.

What is claimed is:

1. In an electron multiplier of the type including a source of electrons and means for collecting electrons multiplied by the electron multiplier spaced apart from the electron source along a longitudinal axis of the electron multiplier, an improved dynode and electron guiding structure, comprising:

a solid dynode formed from a disk of electrically conductive material exhibiting secondary electron emission arranged between the electron source and the electron collecting means, the dynode having a surface oriented in a plane substantially perpendicular to the longitudinal axis of the electron multiplier;

a first guide electrode formed from a cylindrical ring of electrically conductive material and arranged symmetrically about the longitudinal axis of the electron multiplier between the dynode and the electron source, the electrode including an annular flange formed along a portion of the ring remote from the dynode and toward the electron source and directed radially inward toward the longitudinal axis of the electron multiplier to define an opening therein, with the flange being oriented in a plane substantially perpendicular to the longitudinal axis of the electron multiplier;

a second guide electrode formed from an annular ring of electrically conductive material and arranged symmetrically about the dynode, the second electrode including an annular flange formed along a portion of the ring remote from the dynode and on the side opposite to the dynode from the first electrode and directed radially inward toward the longitudinal axis of the electron multiplier to define an opening therein, with the flange being oriented in a plane substantially perpendicular to the longitudinal axis of the electron multiplier; and an electrically conductive grid disposed between the dynode and the electron collecting means, whereby when the dynode and the second guide electrode are placed at the same electrical potential, and an electrical potential is applied to the first guide electrode which is slightly negative with respect to the potential applied to the dynode, and an electrical potential is applied to the grid which is more positive than that applied to the dynode and second guide electrode, the first and second guide electrodes cooperate together to cause substantially all secondary electrons emitted from the surface of the dynode, due to impacts from the electrons from the electron source, to be guided away from the first guide electrode and between the dynode and the second guide electrode and through the grid and focused at an area containing the electron collector.

2. The electron multiplier of claim 1 wherein the electron collecting means is another dynode.

3. The electron multiplier of claim 1 wherein the first guide electrode further includes an electrically conductive screen connected to the flange and disposed within an area bounded by the radially inner edge of the flange.

4. The electron multiplier of claim 1 wherein the dynode is mounted to the inner periphery of the second guide electrode by means of at least three radial arms, at least one of which is formed from an electrically conductive material.

5. The electron multiplier of claim 4 wherein the radial arms are equiangularly spaced from one another about the longitudinal axis of the electron multiplier.

6. The electron multiplier of claim 1 wherein the first guide electrode has a radius less than the radius of the second guide electrode.

7. The electron multiplier of claim 6 wherein the ring portions of the first and second guide electrodes do not overlap each other.

8. The electron multiplier of claim 1 wherein the dynode has a radius which is less than the radius of the first guide electrode.

9. The electron multiplier of claim 8 wherein the dynode has a radius no greater than the radius of the opening defined by the flange of the first guide electrode.

10. The electron multiplier of claim 1 wherein the electrically conductive grid is of semi-hemispherical shape having its convex side oriented toward the dynode.

* * * * *